US005801482A

United States Patent [19]

Verhaar et al.

[11] Patent Number: 5,801,482

[45] Date of Patent: Sep. 1, 1998

[54] LOW-PRESSURE MERCURY VAPOR DISCHARGE LAMP

[75] Inventors: Henricus C.G. Verhaar; Henriëtte J. Talen-Van Der Mheen; Christianus J. Roozekrans; Wilhelmus M.P. Van Kemenade, all of Eindhoven, Netherlands

[73] Assignee: U.S. Phillips Corporation, New York, N.Y.

[21] Appl. No.: 516,417

[22] Filed: Aug. 17, 1995

[30] Foreign Application Priority Data

Aug. 25, 1994 [EP] European Pat. Off. ..... 94202435
Nov. 8, 1994 [EP] European Pat. Off. ..... 94203249

[51] Int. Cl.[6] ..... H01J 01/62; H01J 63/04; H01J 17/26; H01J 17/04

[52] U.S. Cl. ..... 313/483; 313/489; 313/491; 313/492; 313/566; 313/631; 313/634; 313/642

[58] Field of Search ..... 313/110, 112, 313/113, 483, 484, 485, 489, 491, 492, 493, 566, 580, 634, 635, 637, 638, 639, 642, 109, 227

[56] References Cited

U.S. PATENT DOCUMENTS 2,748,306 5/1956 Bjorkman ..... 313/485
3,544,828 12/1970 Bouchard et al. ..... 313/109
3,809,944 5/1974 Jongerius et al. ..... 313/227
4,379,252 4/1983 Work et al. ..... 313/485
4,544,997 10/1985 Seuter et al. ..... 313/483 X
5,258,689 11/1993 Jansma et al. ..... 313/489
5,473,226 12/1995 Beschle et al. ..... 313/580
5,552,671 9/1996 Parham et al. ..... 313/112 X
5,604,396 2/1997 Watanabe et al. ..... 313/485

*Primary Examiner*—Sandra L. O'Shea
*Assistant Examiner*—Mack Haynes
*Attorney, Agent, or Firm*—F. Brice Faller

[57] ABSTRACT

A low-pressure mercury vapor discharge lamp according to the invention is provided with a discharge vessel having a tubular portion and a first and a second end portion. The discharge vessel encloses a discharge space provided with a filling of mercury and a rare gas in a gastight manner. Each end portion supports an electrode which is arranged in the discharge space. Current supply conductors extend from the electrodes through the end portions to outside the discharge vessel. The tubular portion of the discharge vessel is provided with a metal oxide layer on a surface which faces the discharge space. The first and the second end portion are also provided with metal oxide layers at surfaces which face the discharge space. The lamp according to the invention has a comparatively low mercury consumption.

10 Claims, 1 Drawing Sheet

LOW-PRESSURE MERCURY VAPOR DISCHARGE LAMP

BACKGROUND OF THE INVENTION

The invention relates to a low-pressure mercury vapour discharge lamp provided with a discharge vessel having a tubular portion which transmits radiation generated in the discharge vessel and having a first and a second end portion, which discharge vessel encloses a discharge space provided with a filling of mercury and a rare gas in a gastight manner, while the end portions each support an electrode arranged in the discharge space and current supply conductors issue from the electrodes through the end portions to outside the discharge vessel, the tubular portion of the discharge vessel being provided with a metal oxide layer on a surface which faces the discharge space.

Such a lamp is known from U.S. Pat. No. 4,544,997. The tubular portion of the discharge vessel of the known lamp has a layer of at least one oxide of at least one element from the group formed by scandium, yttrium, lanthanum, gadolinium, ytterbium, and lutetium. The metal oxide layer counteracts attacks on the wall of the tubular portion of the discharge vessel owing to interactions with mercury and thus has a favourable influence on the maintenance of the radiation output of the lamp. The metal oxide layer was obtained in that a solution of an organometallic compound was flushed over the surface of the discharge vessel facing the discharge space, and the film remaining on the surface facing the discharge space was subsequently dried and sintered.

The metal oxide layer results in that the mercury consumption of the lamp, i.e. the quantity of mercury bound to lamp components during lamp operation and thus no longer available for lamp operation, is comparatively low as compared with that in lamps not having a metal oxide layer. Nevertheless, a comparatively high mercury dose is necessary also for the known lamp in order to realise a sufficiently long life. This is detrimental to the environment in the case of inexpert disposal at the end of lamp life. A high mercury dose in addition prevents an economically feasible use of mercury enriched with $^{196}Hg$. It is known from U.S. Pat. No. 4,379,252 that a lamp whose mercury filling is enriched with this isotope has a comparatively high efficacy. This isotope, however, is comparatively expensive, so the advantage is wiped out in the case of a high mercury dose by the cost price of the required quantity of the isotope accompanying this dose.

SUMMARY OF THE INVENTION

It is an object of the invention to provide a lamp of the kind described in the opening paragraph which consumes comparatively little mercury.

According to the invention, the lamp is for this purpose characterized in that the first and the second end portion are also each provided with a metal oxide layer on surfaces facing the discharge space.

The overall surface area of the end portions facing the discharge space is small compared with that of the tubular portion. The inventors have found, however, that nevertheless substantially the same quantity of mercury is bound to the end portions in the known lamp as to the tubular portion. It was surprisingly found, moreover, that the presence of a metal oxide layer on the end portions not only strongly reduces the binding of mercury to the end portions, but also causes the quantity of mercury bound to the tubular portion to decrease considerably. It is assumed that the end portions of a lamp not according to the invention desorb impurities such as $CO_2$ and $H_2O$ when a metal oxide layer on the end portions is absent. The end portions assume a comparatively high temperature during operation, which accelerates the desorption of said impurities. Said impurities can be transported to other lamp components through the discharge space and react with mercury from the filling there, so that this mercury is lost to lamp operation. It is assumed that the metal oxide layer on the end portions reduces the desorption of impurities.

A metal oxide layer may be provided on the end portions in that these portions are dipped in a suspension of metal oxide particles and the layer remaining on them is subsequently dried and sintered, i.e. heated so as to drive out auxiliary substances such as binders from the layer. Alternatively, such a layer may be provided, for example, in that the end portions are dipped in a solution of an organometallic compound and the layer is subsequently dried and heated.

A favourable embodiment of the lamp according to the invention is characterized in that the metal oxide layers on the surfaces of the end portions facing the discharge space comprise aluminum oxide and/or yttrium oxide. A comparatively strong decrease in the mercury consumption was found with a layer of aluminum oxide and/or yttrium oxide.

An attractive embodiment of the lamp according to the invention is characterized in that the metal oxide layer on the surface of the tubular portion facing the discharge space comprises at least one oxide of at least one element from the group formed by magnesium, aluminum, titanium, zirconium, and the rare earths. The term "rare earths" in the present description and claims is understood to mean scandium, yttrium, lanthanum, and the lanthanides. Such a layer is highly inert so that the mercury consumption caused by reactions between mercury from the filling and the metal oxide layer is small also in the long term.

Favorable results were obtained with an embodiment of the lamp according to the invention which is characterized in that the metal oxide layer of the tubular portion comprises aluminum oxide and/or yttrium oxide. Such a layer may be provided, for example, in the form of a suspension of aluminum oxide/yttrium oxide particles, for example through atomizing of the suspension or by having this suspension flow over the inner surface of the discharge vessel.

An advantageous embodiment is characterized in that the tubular portion of the discharge vessel carries a further metal oxide layer, which acts as a layer repelling alkali metals, between the surface facing the discharge space and the metal oxide layer (called protective layer hereinafter). A layer repelling alkali metals hampers the transport of alkali metal ions, such as sodium and potassium ions, from the discharge vessel wall to the discharge space. Mercury consumption caused by amalgam formation with alkali metals is counteracted thereby.

A favorable embodiment of the lamp according to the invention is characterized in that the further metal oxide layer comprises silicon oxide. Silicon oxide forms a very good barrier against alkali metal ions. Such a layer is readily provided. It suffices to flush a solution of hydrolyzed tetraethyl orthosilicate over the discharge vessel surface which faces the discharge space. After the silicon oxide layer thus provided on the surface has been dried, the metal oxide layer may be directly provided. A heat treatment is favourable for increasing the density of the layer. The heat treatment coincides, for example, with a heat treatment for the protective layer. If a separate heat treatment is unnecessary also for the protective layer, it is possible to have the heat treatment coincide with a heat treatment for driving auxiliary substances, such as binders, from a suspension of luminescent material in the case in which a luminescent layer is provided on the lamp in the form of a suspension.

The discharge vessel supports, for example, a luminescent layer composed of blue-luminescing barium-magnesium aluminate activated by bivalent europium (BAM), green-luminescing cerium-gadolinium-terbium pentaborate in which terbium acts as an activator (CBT), and red-luminescing yttrium oxide activated by trivalent europium (YOX). This embodiment of the lamp is suitable for lighting purposes. A luminescent layer is absent in another embodiment of the lamp according to the invention. This embodiment of the lamp is suitable, for example, as a UV radiator for disinfection purposes.

DETAILED DESCRIPTION OF THE DRAWING

Figure 1:
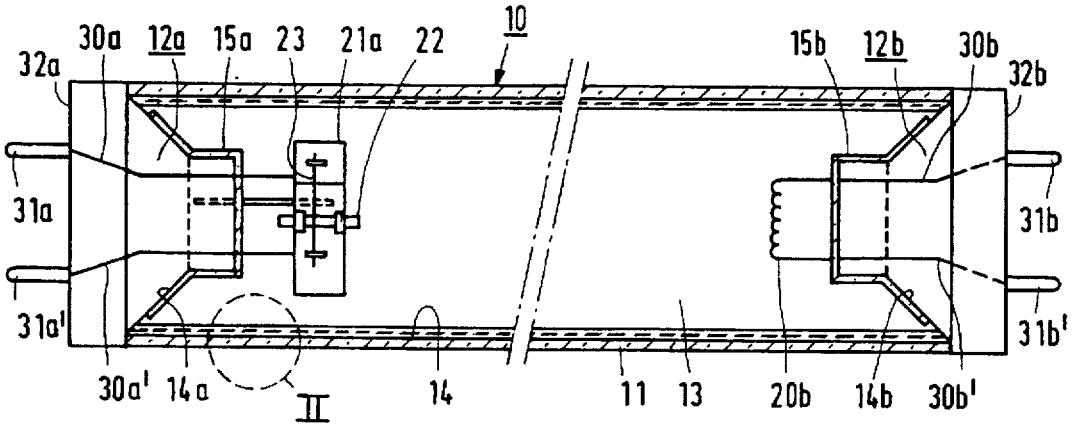
FIG. 1 shows an embodiment of a low-pressure mercury vapour discharge lamp according to the invention in longitudinal sectional view.

FIG. 1 shows a low-pressure mercury vapour discharge lamp provided with a glass discharge vessel 10 having a tubular portion 11 which transmits radiation generated in the discharge vessel 10 and having a first and a second end portion 12*a*, 12*b*. The tubular portion 11 has a length of 120 cm and an internal diameter of 2.5 cm. The discharge vessel 10 encloses a discharge space 13 provided with a filling of 1 mg mercury and a rare gas, here argon, in a gastight manner. The end portions 12*a*, 12*b* each support an electrode 20*b* (the electrode at the first end portion 12*a* is not shown) arranged in the discharge space 13. Current supply conductors 30*a*, 30*a*'; 30*b*, 30*b*' extend from the electrodes 20*b* through the end portions 12*a*, 12*b* to outside the discharge vessel 10. The current supply conductors 30*a*, 30*a*'; 30*b*, 30*b*' are connected to contact pins 31*a*, 31*a*'; 31*b*, 31*b*' which are fastened to lamp caps 32*a*, 32*b*. An electrode ring 21*a* is positioned around each electrode 20*b* (the electrode ring at the second end portion 12*b* is not shown). A glass capsule 22, with which mercury was dosed, is clamped on the electrode ring 21*a*. A metal wire 23 tensioned over the glass capsule 22 was inductively heated in a high-frequency electromagnetic field, whereby the capsule 22 was cut open and the mercury to be dispensed was released from the capsule 22 into the discharge space 13.

Figure 2:
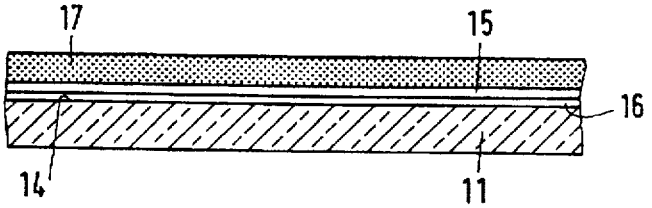
FIG. 2 shows a detail II from FIG. 1.

The tubular portion 11 of the discharge vessel 10 is provided with a metal oxide layer 15 (see FIG. 2) at a surface 14 which faces the discharge space.

The first and the second end portion 12*a*, 12*b* are also provided with metal oxide layers 15*a*, 15*b* at surfaces 14*a*, 14*b* which face the discharge space.

The metal oxide layers 15*a*, 15*b* on the surfaces 14*a*, 14*b* of the end portions 12*a*, 12*b* facing the discharge space comprise yttrium oxide in this case. The yttrium oxide layers 15*a*, 15*b*, which have a coating weight of 15 to 30 μg/cm$^2$, were provided in that the end portions 12*a*, 12*b* were immersed in a solution of yttrium acetate, whereupon the layer remaining on the end portions 12*a*, 12*b* was dried and sintered. In the embodiment shown, the yttrium oxide layers 15*a*, 15*b* extend to 2 to 3 mm away from the seam with the tubular portion 11. This facilitates the fusion of the end portions 12*a*, 12*b* to the tubular portion 11.

The metal oxide layer 15 on the surface 14 of the tubular portion 11 which faces the discharge space comprises an oxide of at least one element from the group formed by magnesium, aluminium, titanium, zirconium, and the rare earths. The metal oxide layer 15 in this case is an yttrium oxide layer with a coating weight of 30 μg/cm$^2$.

The tubular portion 11 of the discharge vessel 10 supports a further metal oxide layer 16, which acts as an alkali metal repelling layer, between the surface 14 facing the discharge space and the yttrium oxide layer 15. In the embodiment shown, the further metal oxide layer 16 is made of silicon oxide and has a coating weight of 12 μg/cm$^2$. The yttrium oxide layer 15 supports a luminescent layer 17 with a coating weight of 1.8 mg/cm$^2$ comprising the luminescent materials BAM, CBT and YOX.

A lamp not according to the invention was manufactured for comparison purposes, lacking a metal oxide layer on the end portions but corresponding to the lamp according to the invention in all other respects.

The lamps were subjected to an endurance test of 5000 hours. After the endurance test, the quantity of mercury bound to the end portions (A) and to the tubular portion (B) was ascertained by means of a wet-chemical analysis. The results (in μg) are shown in Table 1 for the lamp according to the invention (I) and the lamp not according to the invention (II).

TABLE 1

| | Quantity of bound mercury in μg in the lamp according to the invention I and not according to the invention II. | |
|---|---|---|
| Lamp component | I | II |
| A | 10 | 61 |
| B | 24 | 73 |

The measure according to the invention leads to a strong reduction in the quantity of mercury bound at the end portions (A), but the quantity of bound mercury at the tubular portion (B) is also considerably smaller.

For further investigation, two groups of 10 lamps according to the invention and one group of 10 lamps not according to the invention were manufactured. The tubular portion of the discharge vessel was provided with a luminescent layer in all cases, while an aluminium oxide layer was present between the surface of the tubular portion facing the discharge space and the luminescent layer. The aluminum oxide layer was obtained from a suspension of aluminium oxide particles, here of the Degussa Alon-C type. Five out of each group of ten lamps was in addition provided with an alkali metal repelling layer of silicon oxide between the surface of the tubular portion facing the discharge space and the aluminum oxide layer. The silicon oxide layer was provided in that a solution of hydrolyzed tetraethyl orthosilicate was flushed over the surface of the discharge vessel which faces the discharge space. The silicon oxide layer and the aluminum oxide layer have respective coating weights of 12 and 55 μg/cm$^2$. The coating weight of the luminescent layer is 1.8 mg/cm$^2$. The end portions of the lamps according to the invention of the first group are provided with an yttrium oxide layer with a coating weight of approximately 30 μg/cm$^2$. In the second group of lamps according to the invention, the end portions are provided with an aluminum oxide layer with a coating weight of approximately 250

μg/cm$^2$, while the group of lamps not according to the invention has no metal oxide layer on the end portions.

The lamps were provided with a filling of 0.4 mg mercury and argon. The total quantity of bound mercury was measured after 1000 hours of operation. The measuring method used is based on the phenomenon that free mercury moves to the negative electrode in a DC-operated lamp. The displacement of mercury is visible in the form of a decrease in intensity of the light radiated by the lamp near the end of the positive electrode.

In the embodiment of the measuring method used during the test, the polarity of the DC voltage was reversed the moment the luminous intensity near the end of the positive pole had dropped to 60% of the rated value. The time which elapses between this moment and the moment at which the luminous intensity near the opposite end has dropped to 60% of the rated value is a measure for the quantity of free mercury still available, and thus for the mercury consumption. The measuring method was calibrated by means of the results obtained by a wet-chemical analysis.

The mercury consumption (in μg) in the period up to 1000 hours is shown in Table II. The Table also indicates between parentheses the mercury consumption in the period from 1 to 1000 hours.

TABLE 2

Mercury consumption in μg in the operating period up to 1000 hours, and mercury consumption in the operating period from 1 to 1000 hours (between parentheses) for lamps according to the invention and lamps not according to the invention.

| Coating of | Coating of end portions | | |
|---|---|---|---|
| tubular portion | $Y_2O_3$ | $Al_2O_3$ | — |
| $Al_2O_3$ | 225 (144) | 220 (114) | 291 (196) |
| $SiO_2/Al_2O_3$ | 168 (83) | 147 (69) | 200 (112) |

It is again apparent from the measurements that the measure according to the invention results in a significant decrease in the mercury consumption. The mercury consumption during the first hour of operation (80 to 110 μg) is substantially independent of the coating of the tubular portion and the coating or absence thereof on the end portions. In the period after the first hour of operation, the measure according to the invention results in a comparatively strong reduction in the mercury consumption. The reduction ranges from 26% with the use of an yttrium oxide layer as the metal oxide layer on the end portions of lamps having a metal oxide layer of yttrium oxide combined with an alkali metal repelling layer of silicon oxide on the tubular portion, to 42% with the use of an aluminum oxide layer on the end portions of lamps having besides a luminescent layer exclusively an aluminum oxide layer on the tubular portion. The lowest mercury consumption was found in lamps whose tubular portions of the discharge vessels were provided with an aluminium oxide layer supported by a silicon oxide layer, while the end portions were coated with aluminium oxide.

We claim:

1. A low-pressure mercury vapour discharge lamp provided with a discharge vessel (10) having a tubular portion (11) which transmits radiation generated in the discharge vessel (10) and having a first and a second end portion (12*a*,12*b*), which discharge vessel (10) encloses a discharge space (13) provided with a filling of mercury and a rare gas in a gastight manner, while the end portions (12*a*, 12*b*) each support an electrode (20*b*) arranged in the discharge space (13) and current supply conductors (30*a*,30*a*';30*b*,30*b*') issue from the electrodes (20*b*) through the end portions (12*a*,12*b*) to outside the discharge vessel (10), the tubular portion (11) of the discharge vessel (10) being provided with a metal oxide layer (15) on a surface (14) which faces the discharge space, wherein the first and the second end portions each have a surface facing the discharge space, which surfaces are each provided with a yttrium oxide layer (15*a*,15*b*).

2. A low-pressure mercury vapour discharge lamp as claimed in claim 1, characterized in that the metal oxide layer (15) on the surface (14) of the tubular portion (11) facing the discharge space comprises at least one oxide of at least one element selected from the group formed by magnesium, aluminum, titanium, zirconium, and the rare earths.

3. A low-pressure mercury vapour discharge lamp as claimed in claim 2, characterized in that said metal oxide layer (15) comprises aluminum oxide and/or yttrium oxide.

4. A low-pressure mercury vapour discharge lamp as claimed in claim 3, characterized in that the tubular portion (11) of the discharge vessel (10) carries a further metal oxide layer (16), which acts as a layer repelling alkali metals, between the surface (14) facing the discharge space and the metal oxide layer (15).

5. A low-pressure mercury vapour discharge lamp as claimed in claim 4, characterized in that the further metal oxide layer (16) comprises silicon oxide.

6. A low-pressure mercury vapour discharge lamp as claimed claim 2, characterized in that the tubular portion (11) of the discharge vessel (10) carries a further metal oxide layer (16), which acts as a layer repelling alkali metals, between the surface (14) facing the discharge space and the metal oxide layer (15).

7. A low-pressure mercury vapour discharge lamp as claimed in claim 6, characterized in that the further metal oxide layer (16) comprises silicon oxide.

8. A low-pressure mercury vapour discharge lamp as claimed claim 1, characterized in that the tubular portion (11) of the discharge vessel (10) carries a further metal oxide layer (16), which acts as a layer repelling alkali metals, between the surface (14) facing the discharge space and the metal oxide layer (15).

9. A low-pressure mercury vapour discharge lamp as claimed in claim 8, characterized in that the further metal oxide layer (16) comprises silicon oxide.

10. A low-pressure mercury vapour discharge lamp as claimed in claim 1, characterized in that the metal oxide layer (15) on the surface (14) of the tubular portion (11) facing the discharge space comprises at least one oxide of at least one element from the series formed by magnesium, aluminum, titanium, zirconium, and the rare earths.

* * * * *